US011766092B2

(12) United States Patent
Maselino et al.

(10) Patent No.: US 11,766,092 B2
(45) Date of Patent: Sep. 26, 2023

(54) SOLE STRUCTURE FOR ARTICLE OF FOOTWEAR

(71) Applicant: NIKE, Inc., Beaverton, OR (US)

(72) Inventors: Gabriel T. Maselino, Portland, OR (US); George A. Xanthos, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 142 days.

(21) Appl. No.: 16/796,997

(22) Filed: Feb. 21, 2020

(65) Prior Publication Data

US 2021/0259356 A1 Aug. 26, 2021

(51) Int. Cl.
*A43B 13/14* (2006.01)

(52) U.S. Cl.
CPC ..... *A43B 13/14* (2013.01)

(58) Field of Classification Search
CPC ..... A43B 13/14; A43B 7/148; A43B 13/125; A43B 7/149; A43B 7/146; A43B 13/122
See application file for complete search history.

(56) References Cited

U.S. PATENT DOCUMENTS 4,839,948 A * 6/1989 Boros ..... A43B 3/24 24/664
4,897,936 A 2/1990 Fuerst
5,079,856 A 1/1992 Truelsen
5,572,804 A * 11/1996 Skaja ..... A43B 13/20 36/35 B
6,016,613 A 1/2000 Campbell et al.
6,354,020 B1 * 3/2002 Kimball ..... A43B 13/203 36/35 B
7,254,909 B2 8/2007 Ungari
7,266,908 B2 9/2007 Issler
7,451,557 B2 11/2008 McDonald et al.
7,627,963 B2 12/2009 Kilgore
8,079,160 B2 12/2011 Baucom et al.
8,220,182 B2 7/2012 Righetto
8,256,145 B2 9/2012 Baucom et al.
8,453,349 B2 6/2013 Auger et al.
8,474,155 B2 7/2013 McDonald et al.
8,656,610 B2 2/2014 Baucom et al.
8,656,611 B2 2/2014 Baucom et al.
8,758,207 B2 6/2014 Elbaz et al.
8,919,016 B2 12/2014 McDonald et al.
9,055,788 B2 6/2015 Elbaz et al.
9,289,032 B2 3/2016 Auger et al.
(Continued)

FOREIGN PATENT DOCUMENTS

KR 101346338 B1 2/2014
KR 101366699 B1 2/2014

*Primary Examiner* — Clinton T Ostrup
*Assistant Examiner* — Akwokwo Olabisi Redhead
(74) *Attorney, Agent, or Firm* — Bookoff McAndrews, PLLC

(57) ABSTRACT

A sole structure for an article of footwear includes a chassis including a footbed having an interior surface and an outer surface formed on an opposite side from the interior surface, the interior surface defining one or more sockets. The sole structure also includes one or more haptic elements each having a bottom surface received within a respective one of the one or more sockets and a top surface protruding from the interior surface of the chassis, each of the one or more haptic elements having a different hardness than the footbed.

19 Claims, 11 Drawing Sheets

(56) References Cited

U.S. PATENT DOCUMENTS 9,504,293 B2 11/2016 Tsang
9,516,917 B2 12/2016 Hoffer et al.
9,516,918 B2 12/2016 Meschter et al.
9,883,715 B2 2/2018 McDonald et al.
9,955,749 B2 * 5/2018 Van Atta ..... A43B 7/146
10,010,136 B2 7/2018 Shaffer et al.
10,034,514 B2 7/2018 Meschter et al.
10,172,417 B2 1/2019 Hoffer et al.
10,182,614 B2 1/2019 Meschter et al.
2003/0208930 A1 * 11/2003 Swigart ..... A43B 13/189 36/29
2005/0268487 A1 * 12/2005 Ellis, III ..... A43B 13/14 36/25 R
2005/0268490 A1 * 12/2005 Foxen ..... A43B 13/189 36/28
2007/0240333 A1 * 10/2007 Le ..... A43B 17/10 36/103
2008/0160772 A1 * 7/2008 Kong ..... H01L 21/0332 257/E21.214
2008/0184594 A1 8/2008 Ebeling
2011/0126422 A1 * 6/2011 Vattes ..... A43B 13/145 36/10
2011/0192056 A1 8/2011 Geser et al.
2013/0278436 A1 * 10/2013 Ellis ..... G16H 20/30 36/43
2014/0075779 A1 * 3/2014 Bruce ..... A43B 7/148 36/29
2014/0250723 A1 9/2014 Kohatsu
2015/0040436 A1 2/2015 Clerc et al.
2016/0081427 A1 3/2016 Iuchi et al.
2017/0071289 A1 * 3/2017 Auyang ..... A43B 13/188
2017/0367439 A1 12/2017 Fallon
2018/0008005 A1 1/2018 Compton et al.
2018/0213886 A1 * 8/2018 Connell ..... A43B 13/125
2018/0303197 A1 10/2018 Chen et al.
2019/0069630 A1 3/2019 Hopkins
2021/0219655 A1 * 7/2021 Duemler ..... A43B 1/08

* cited by examiner 10
134b
136
138
140a
14
142
140b
24
248b
144
122b
124b
132b
112
118
130
102, 104
146c
146d
148e
148d
116
128
126
108
16
132a
148c
148f
124a
18
146e
148g
146a
142
106
22
248a
144
108
148b
110
122a
296
146a
134b
298b
294
136
100
148a
151
292
298a
200
20
12

SOLE STRUCTURE FOR ARTICLE OF FOOTWEAR

FIELD

The present disclosure relates generally to articles of footwear, and more particularly to a sole structure for an article of footwear.

BACKGROUND

This section provides background information related to the present disclosure, which is not necessarily prior art.

Articles of footwear conventionally include an upper and a sole structure. The upper may be formed from any suitable material(s) to receive, secure and support a foot on the sole structure. The upper may cooperate with laces, straps, or other fasteners to adjust the fit of the upper around the foot. For instance, laces may be tightened to close the upper around the foot. A bottom portion of the upper, proximate to a bottom surface of the foot, attaches to the sole structure.

Sole structures generally include a layered arrangement extending between an outsole providing abrasion-resistance and traction with a ground surface and a midsole disposed between the outsole and the upper for providing cushioning for the foot. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
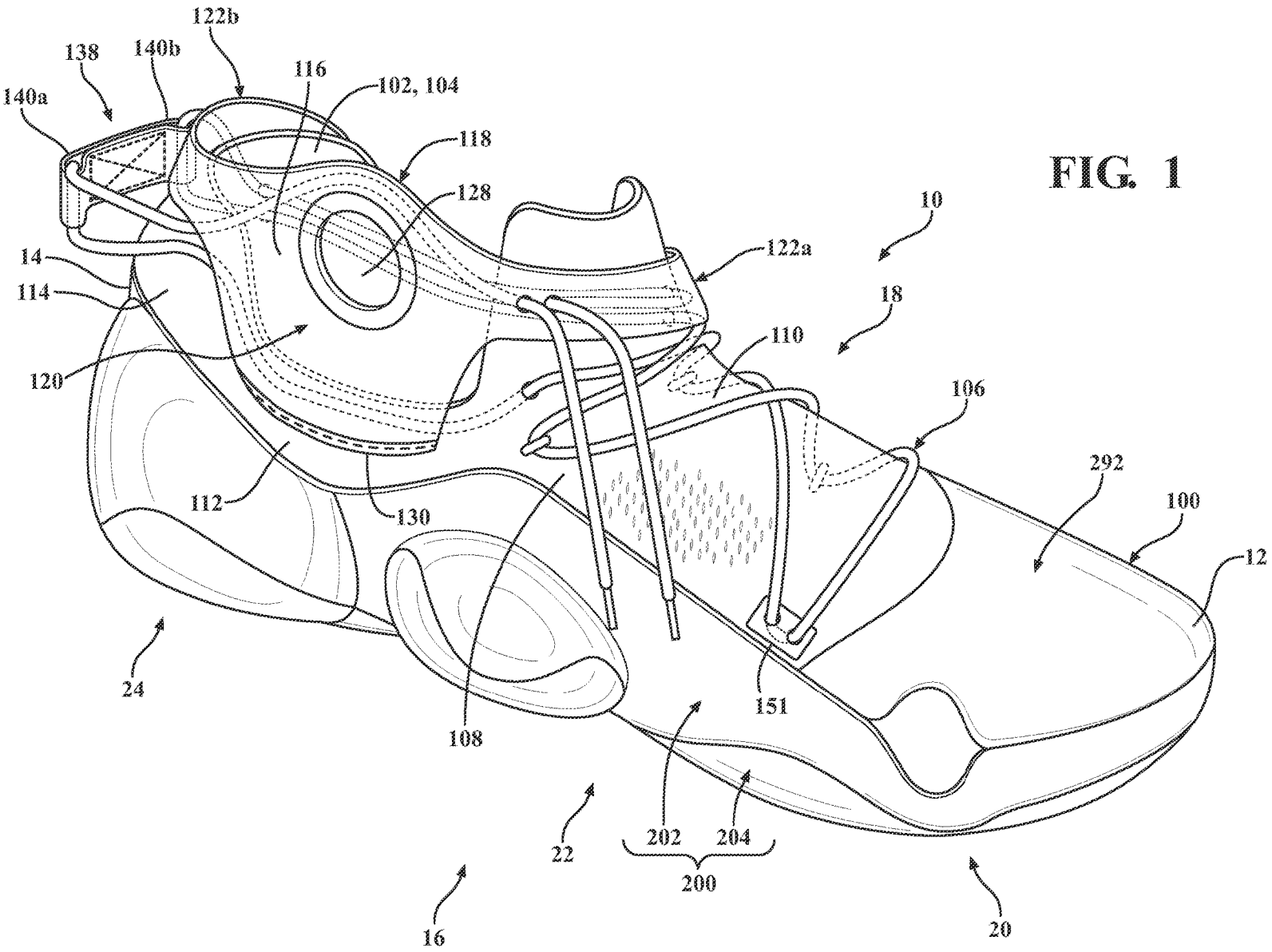
FIG. 1 is a perspective view of an article of footwear according to principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a chassis including a footbed having an interior surface and an outer surface formed on an opposite side from the interior surface. The interior surface defines one or more sockets. The sole structure also includes one or more haptic elements each having a bottom surface received within a respective one of the one or more sockets and a top surface protruding from the interior surface of the chassis. Each of the one or more haptic elements has a different hardness than the footbed.

Implementations of the disclosure may include one or more of the following optional features. In some implementations, at least one of the one or more haptic elements is disposed in a forefoot region of the chassis. Additionally or alternatively, at least one of the one or more haptic elements may be disposed in a heel region of the chassis. Each of the one or more haptic elements may have a lower hardness than the footbed.

In some examples, the one or more haptic elements includes a first haptic element having a first hardness and a second haptic element having a second hardness. Here, the first haptic element may be disposed in a forefoot region of the chassis and the second haptic element may be disposed in a heel region of the chassis.

In some configurations, each of the one or more sockets forms an opening in the chassis, the bottom surface of each of the one or more haptic elements being exposed through the opening. Here, the bottom surface of each of the one or more haptic elements may protrude through the opening.

In some implementations, the sole structure includes an outsole having an inner surface facing the outer surface of the chassis and an exterior surface formed on an opposite side of the outsole than the inner surface, the bottom surface of each of the one or more haptic elements extending at least partially through the outsole. Here, the outer surface of the outsole may include one or more depressions each surrounding at least one of the one or more haptic elements.

Another aspect of the disclosure provides a sole structure for an article of footwear. The sole structure includes a chassis including a footbed having a first hardness and a plurality of sockets formed at least partially through the footbed. The sole structure also includes one or more haptic elements each received within a respective one of the sockets and having a top surface protruding from the footbed of the chassis. Each of the one or more haptic elements has a different hardness than the first hardness.

This aspect may include one or more of the following optional features. In some examples, at least one of the one or more haptic elements is disposed in a forefoot region of the chassis. Optionally, at least one of the one or more haptic elements may be disposed in a heel region of the chassis. Each of the one or more haptic elements may have a lower hardness than the footbed.

In some configurations, the one or more haptic elements includes a first haptic element having a second hardness and a second haptic element having a third hardness different than the second hardness. Here, the first haptic element may be disposed in a forefoot region of the chassis and the second haptic element may be disposed in a heel region of the chassis.

In some implementations, each of the one or more sockets forms a respective opening in the chassis, each of the one or more haptic elements being exposed through one of the openings. Here, each of the one or more haptic elements may protrude through one of the openings. The sole structure may also include an outsole attached to the footbed and including one or more apertures aligned with each of the openings. Here, each of the one or more haptic elements may be exposed to and spaced apart from a ground surface through a respective one of the one or more apertures.

The details of one or more implementations of the disclosure are set forth in the accompanying drawings and the description below. Other aspects, features, and advantages will be apparent from the description and drawings, and from the claims.

Figure 4A:
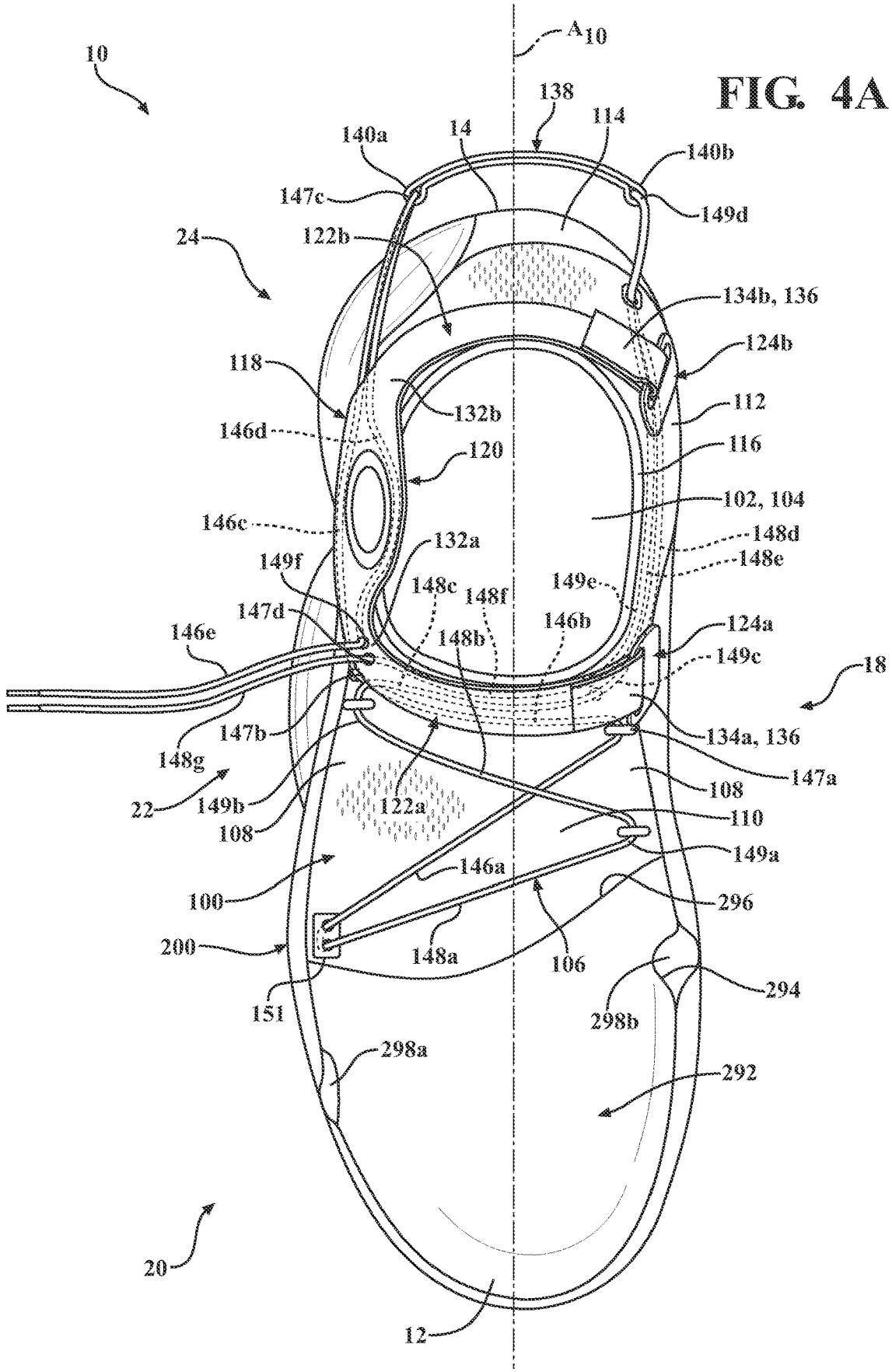
FIG. 4A is a top plan view of the article of footwear of FIG. 1, showing the article of footwear in a first configuration.

Referring to FIG. 1, an article of footwear 10 includes an upper 100 and sole structure 200. The footwear 10 may further include an anterior end 12 associated with a forward-most point of the footwear 10, and a posterior end 14 corresponding to a rearward-most point of the footwear 10. As shown in FIG. 4A, a longitudinal axis $A_{10}$ of the footwear 10 extends along a length of the footwear 10 from the anterior end 12 to the posterior end 14 parallel to a ground surface, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the lateral side 16 to the medial side 18.

The article of footwear 10 may be divided into one or more regions. The regions may include a forefoot region 20, a mid-foot region 22, and a heel region 24. The forefoot region 20 may be subdivided into a toe portion $\mathbf{20}_T$ corresponding with phalanges, and a ball portion $\mathbf{20}_B$ associated with metatarsal bones of a foot. The mid-foot region 22 may correspond with an arch area of the foot, and the heel region 24 may correspond with rear portions of the foot, including a calcaneus bone.

The upper 100 forms an enclosure having plurality of components that cooperate to define an interior void 102 and an ankle opening 104, which receive and secure a foot for support on the sole structure 200. As discussed in greater detail below, the upper 100 may be provided with a tensioning element 106 operable to move the upper 100 and the article of footwear 10 between a tightened state and a relaxed state.

While the following paragraphs describe the geometry of the upper 100 in terms of different components, the upper 100 may be formed of a single piece of material, such that the following components are merely provided as reference points or regions along the upper 100. For example, the upper 100 may be formed as a sock-like, knitted upper 100. Optionally, the components of the upper 100 may be formed from one or more materials that are stitched or adhesively bonded together to define the interior void 102.

Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the article of footwear 10 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

The components or regions of the upper 100 include a pair of quarter panels 108 in the mid-foot region 22 on opposite sides of the interior void 102. A throat 110 extends across the top of the upper 100 and defines an instep region extending between the quarter panels 108 from the ankle opening 104 to the forefoot region 20. In the illustrated example, the throat 110 is enclosed, whereby a material panel extends between the opposing quarter panels 108 in the instep region to cover the interior void 102. Optionally, the material panel covering the throat 110 may be formed of a material having a higher modulus of elasticity than the material forming the quarter panels 108.

The upper 100 of the article of footwear 10 may be further described as including heel side panels 112 extending through the heel region 24 along the lateral and medial sides 16, 18 of the ankle opening 104. A heel counter 114 wraps around the posterior end 14 of the footwear 10 and connects the heel side panels 112. Uppermost edges of the throat 110, the heel side panels 112, and the heel counter 114 cooperate to form a collar 116, which defines the ankle opening 104 of the interior void 102.

In the illustrated example, the upper 100 includes a stabilizer 118 attached to the heel side panel 112 on the lateral side 16 of the upper 100, adjacent to the collar 116. Generally, the stabilizer 118 is configured to provide an increased level of support and sensory feedback along the lateral side 16 of an ankle of the wearer. The stabilizer 118 includes a central brace 120 attached to the lateral heel side panel 112, and a pair of straps 122*a*, 122*b* extending from opposite edges or ends of the central brace 120. Additionally, the upper 100 includes a pair of buckles 124*a*, 124*b* attached to the medial side 18 of the upper 100, which are respectively configured for selectively securing the straps 122*a*, 122*b* of the stabilizer 118 to the upper 100.

Figure 2:
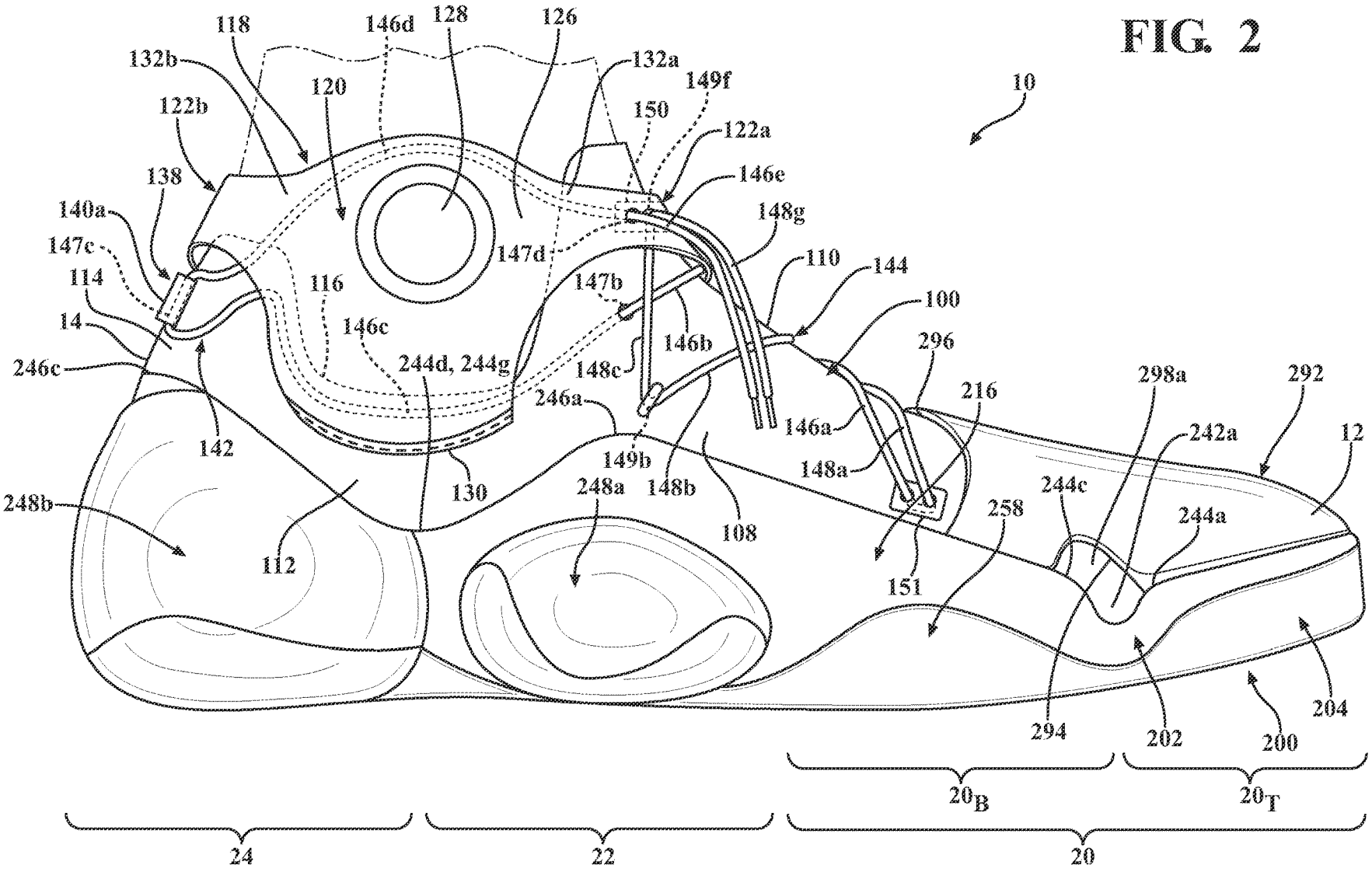
FIG. 2 is a lateral side elevation view of the article of footwear of FIG. 1.
Figure 4B:
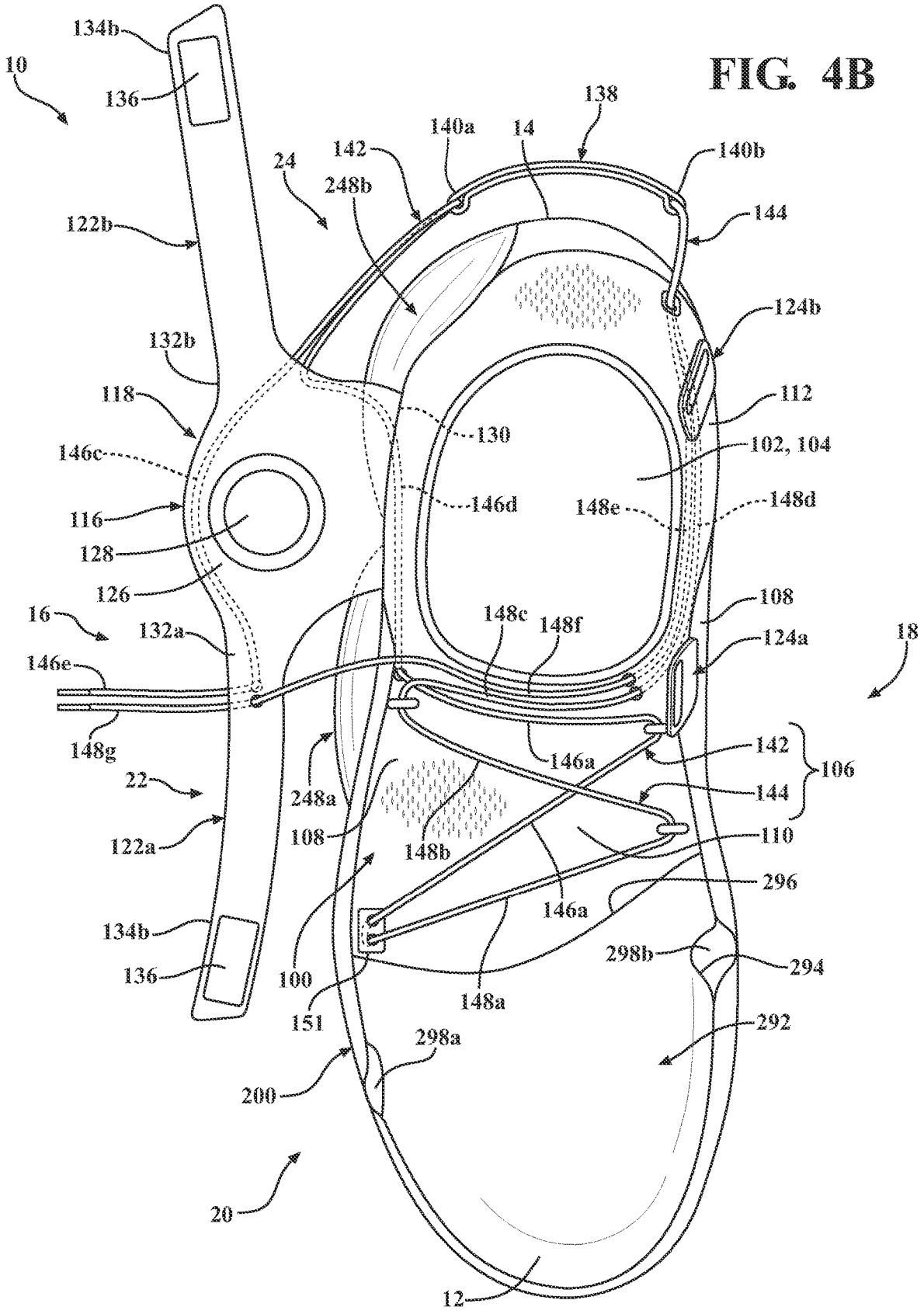
FIG. 4B is a top plan view of the article of footwear of FIG. 1, showing the article of footwear in a second configuration.

Turning now to FIG. 2, the central brace 120 of the stabilizer 118 includes a peripheral portion 126 surrounding an opening 128. A bottom edge 130 of the peripheral portion 126 is attached to the heel side panel 112 adjacent to the collar 116. Here, the bottom edge 130 is fixedly attached to the heel side panel 112, and forms a living hinge, thereby allowing the stabilizer 118 to be folded away from the ankle opening 104, as shown in FIG. 4B. The opening 128 of the central brace 120 is configured and arranged to receive the lateral malleolus of the wearer when the foot is received within the interior void 102. Accordingly, the peripheral portion 126 of the central brace 120 is configured to surround the lateral malleolus of the wearer when the article of footwear 10 is in the tightened state (FIG. 4A), as discussed below.

Figure 3:
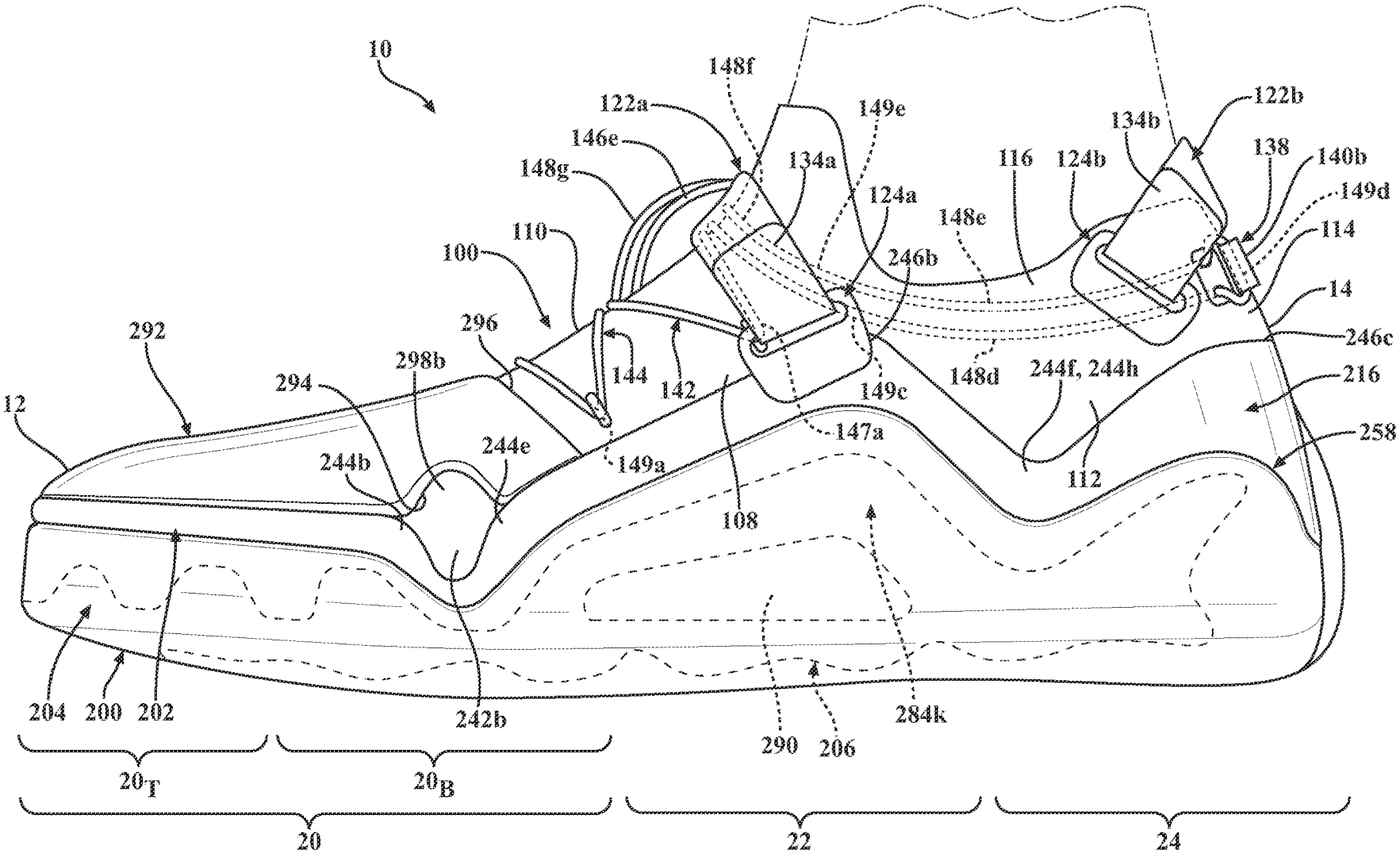
FIG. 3 is a medial side elevation view of the article of footwear of FIG. 1.

With continued reference to FIGS. 2 and 3, the straps 122*a*, 122*b* of the stabilizer 118 extend from opposite edges or ends of the peripheral portion 126 of the brace 120 and are configured to wrap around the ankle opening 104 to secure the stabilizer 118 in a tightened state against the ankle of the wearer. Here, an anterior strap 122*a* extends from a first end 132*a* attached at an anterior edge of the brace 120 to a second end 134*a* operable to be selectively attached to one of the buckles 124*a* on the medial side 18 of the upper 100. Similarly, a posterior strap 122*b* extends from a first end 132*b* attached at a posterior edge of the brace 120 to a second end 134*b* operable to be selectively attached to a second one of the buckles 124*b* on the medial side 18 of the upper 100. In the illustrated example, the second ends 134*a*, 134*b* of the straps 122*a*, 122*b* include fastening elements 136 for securing the straps 122*a*, 122*b* to the buckles 124*a*, 124*b*.

Referring still to FIG. 3, the buckles 124*a*, 124*b* include a first buckle 124*a* attached at an anterior end of the ankle opening 104 on the medial side 18 of the article of footwear 10, and a second buckle 124*b* attached at a posterior end of the ankle opening 104 on the medial side 18 of the article of footwear 10. As provided above, the second end 134*a* of the anterior strap 122*a* removably attaches to the first buckle 124*a* and the second end 134*b* of the posterior strap 122*b* removably attaches to the second buckle 124*b* to selectively secure the stabilizer 118 in a tightened or closed configuration, as shown in FIG. 4A.

As discussed in greater detail below, the sole structure 200 may have an increased height along the quarter panel 108 on the medial side 18, such that a portion of the sole structure 200 in the mid-foot region 22 terminates adjacent to the collar 116 at the anterior end of the ankle opening 104. Here, the first buckle 124*a* may be attached to a portion of the sole structure 200 that extends over the quarter panel 108 on the medial side 18. The second buckle 124*b* is attached to the upper 100 adjacent to the collar 116, between the heel side panel 112 and the heel counter 114 on the medial side 18. As shown, each of the buckles 124*a*, 124*b* may be a loop for receiving the second ends 134*a*, 134*b* of the straps 122*a*, 122*b* therethrough.

As best shown in FIGS. 4A and 4B, the upper 100 may further include a heel strap 138 disposed adjacent to the heel counter 114. The heel strap 138 is configured to float with respect to the heel counter 114 and, as such, is not directly attached to the heel counter 114. In other words, the heel strap 138 is detached from the heel counter 114, and only connects to the tensioning element 106. As shown, the heel strap 138 includes a lateral end 140*a* disposed adjacent to the heel counter 114 on the lateral side 16, and a medial end 140*b* disposed adjacent to the heel counter 114 on the medial side 18. Each end 140*a*, 140*b* forms a loop or passageway for routing the tensioning element 106 of the upper 100 along the heel region 24.

As best shown in FIGS. 4A and 4B, the tensioning element 106 of the upper 100 includes a lateral strand 142 generally routed along the lateral side 16 of the ankle opening 104, and a medial strand 144 generally routed along the medial side 18 of the ankle opening 104. Although each of the strands 142, 144 is formed as a continuous lace routed along the components or regions of the upper 100, the routing of the strands 142, 144 is described in terms of lateral strand segments 146*a*-146*e* and medial strand segments 148*a*-148*g*. Furthermore, each of the strands 142, 144 may be part of the same continuous tensioning element 106, or may be formed as separate strands 142, 144 that are independently attached to the upper 100 to collectively form the tensioning element 106.

As best shown in FIGS. 2, 4A and 4B, the lateral strand 142 includes a first segment 146*a* extending across the upper 100 from a first end attached to the upper 100 at a fixture 151 on the lateral side 16 in the forefoot region 20, to a first turn 147*a* on the medial side 18 of the upper 100 in the mid-foot region 22. From the first turn 147*a*, a second segment 146*b* extends across the throat 110 to a second turn 147*b* on the lateral side 16 of the upper 100 in the mid-foot region 22. A third segment 146*c* is routed from the second turn 147*b* along the lateral side 16 and passes through the peripheral portion 126 of the stabilizer 118, below the opening 128. The third segment 146*c* is routed along the lower portion of the stabilizer 118 and exits the heel counter 114 on the lateral side 16 to form a third turn 147*c* through the lateral end 140*a* of the heel strap 138. From the heel strap 138, a fourth segment 146*d* is routed through the peripheral portion 126 of the stabilizer 118 above the opening 128, and to a clasp 150 disposed between the central brace 120 and the anterior strap 122*a* of the stabilizer 118. The lateral strand 142 extends through the clasp 150, where a free-hanging fifth segment 146*e* can be grasped by a wearer to pull the lateral strand 142 and move the footwear 10 to a tightened state.

With reference to FIGS. 3-4B, the medial strand 144 includes a first segment 148*a* extending from a first end attached to the upper 100 at the fixture 151 on the lateral side, adjacent to the first end of the lateral strand 142. In some examples, the strands 142, 144 may be attached to each other at the fixture 151. From the fixture 151, the first segment 148*a* extends across the upper 100 to a first turn 149*a* on the medial side 18 of the upper 100 in the mid-foot region 22. As shown, the first turn 149*a* of the medial strand 144 is disposed closer to the anterior end 12 than the first turn 147*a* of the lateral strand 142. A second segment 148*b* of the medial strand 144 extends from the first turn 149*a* and across the throat 110 to a second turn 149*b* on the lateral side 16 in the mid-foot region 22. From the second turn 149*b*, a third segment 148*c* extends to the medial side 18 of the upper 100 to a third turn 149*c* adjacent to the collar 116 at an anterior end of the ankle opening 104. A fourth segment 148*d* extends along the medial heel side panel 112 on the medial side 18 and exits the upper 100 at the heel counter 114. The medial strand 144 is then routed through the medial end 140*b* of the heel strap 138 to form a fourth turn 149*d* between the fourth segment 148*d* and a fifth segment 148*e*. The fifth segment 148*e* returns from the heel strap 138 and is routed back along the medial heel side panel 112 towards the anterior end of the ankle opening 104 to a fifth turn 149*e*, where a sixth segment 148*f* extends from the fifth turn 149*e* and across the throat 110. The sixth segment 148*f* exits the throat 110 of the upper 100 on the lateral side 16 and is routed from a through the clasp 150. A seventh segment 148*g* of the medial strand 144 extends from the stabilizer 118 and can be gripped by the wearer to apply a tensioning force FT to the medial strand 144.

By routing the lateral strand 142 and the medial strand 144 along opposite sides of the ankle opening 104, the strands 142, 144 serve to provide increased lateral stability to the upper 100 when the footwear 10 is in the tightened state. Additionally, the strands 142, 144 may serve to provide tactile feedback to each of the lateral and medial sides 16, 18 of the ankle during use, heightening a sense of mobility for the wearer. With particular reference to the lateral strand 142, the third segment 146*c* and the fourth segment 146*d* are routed above and below the opening 128 such that these segments 146*c*, 146*d* will surround the lateral malleolus of the wearer when the stabilizer 118 is in the tightened or closed configuration (FIG. 4A). Accordingly, during lateral movement towards the medial side 18 of the footwear 10, such as during a medial-side cut or twist, the segments 146*c*, 146*d* cooperate to reinforce the stabilizer 118 and to provide responsive proprioceptive stimulation to the lateral side 16 of the ankle of the wearer.

Figure 5:
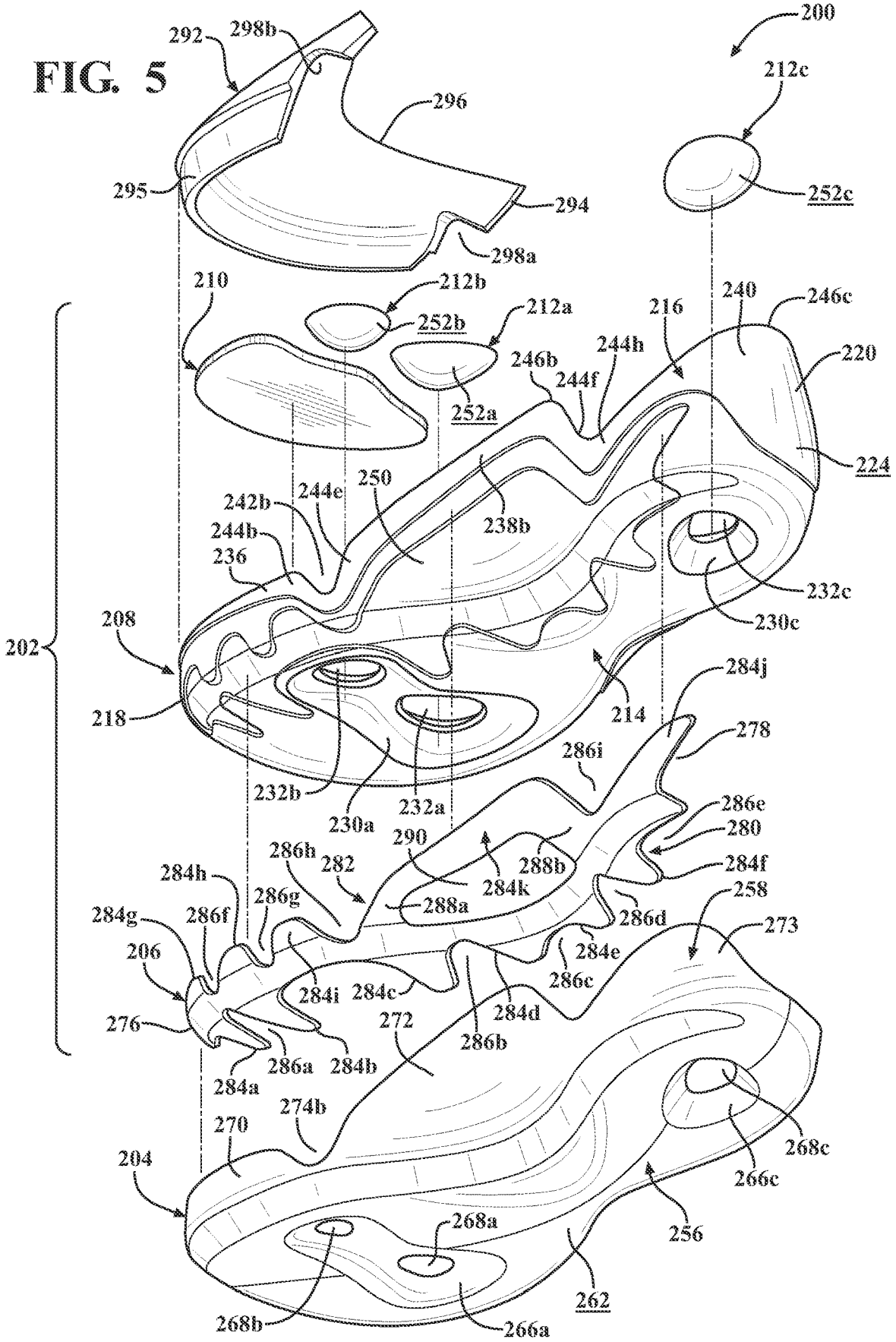
FIG. 5 is an exploded, bottom-posterior perspective view of a sole structure for an article of footwear according to principles of the present disclosure.
Figure 6:
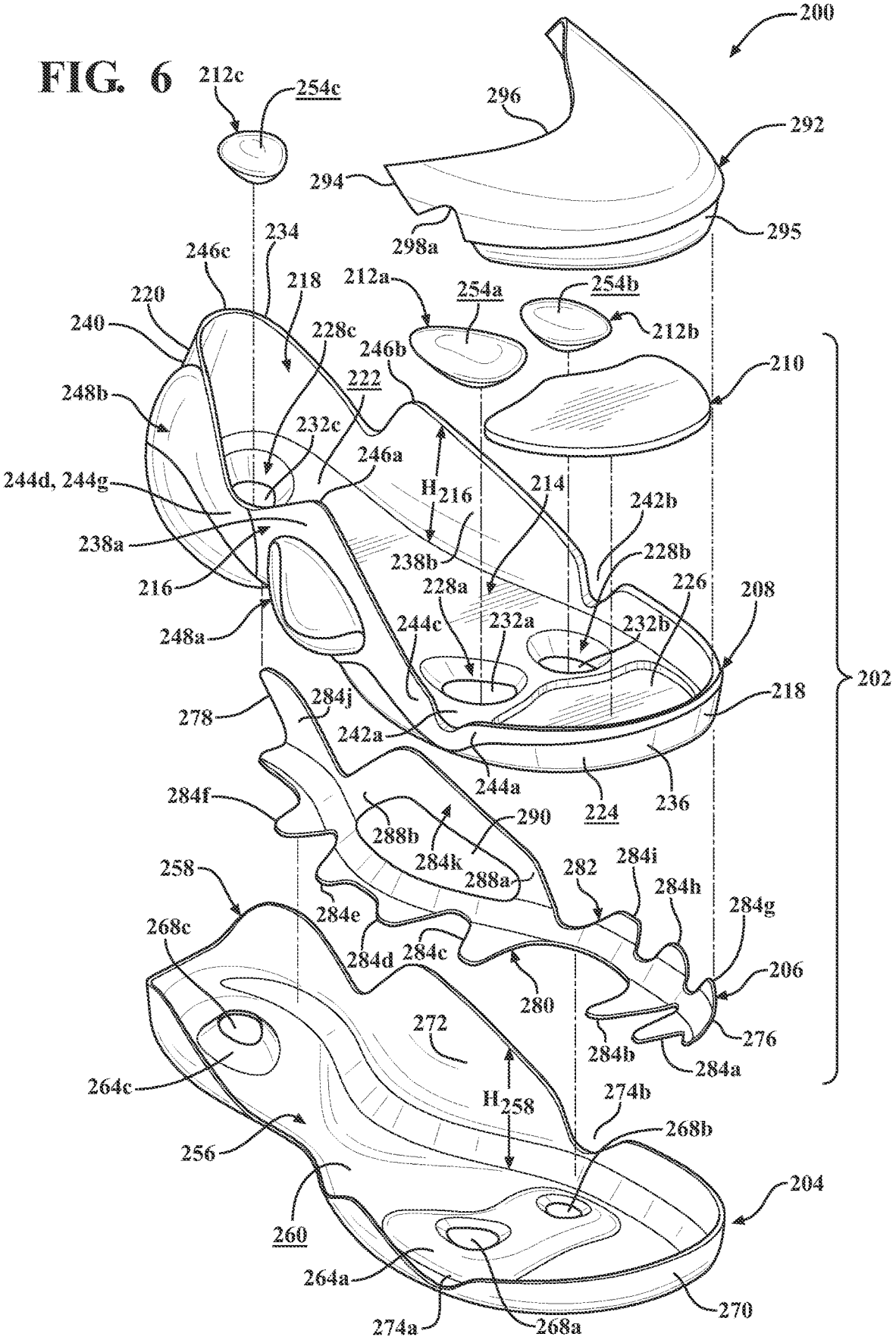
FIG. 6 is an exploded, top-anterior perspective view of the sole structure of FIG. 5.
Figure 7:
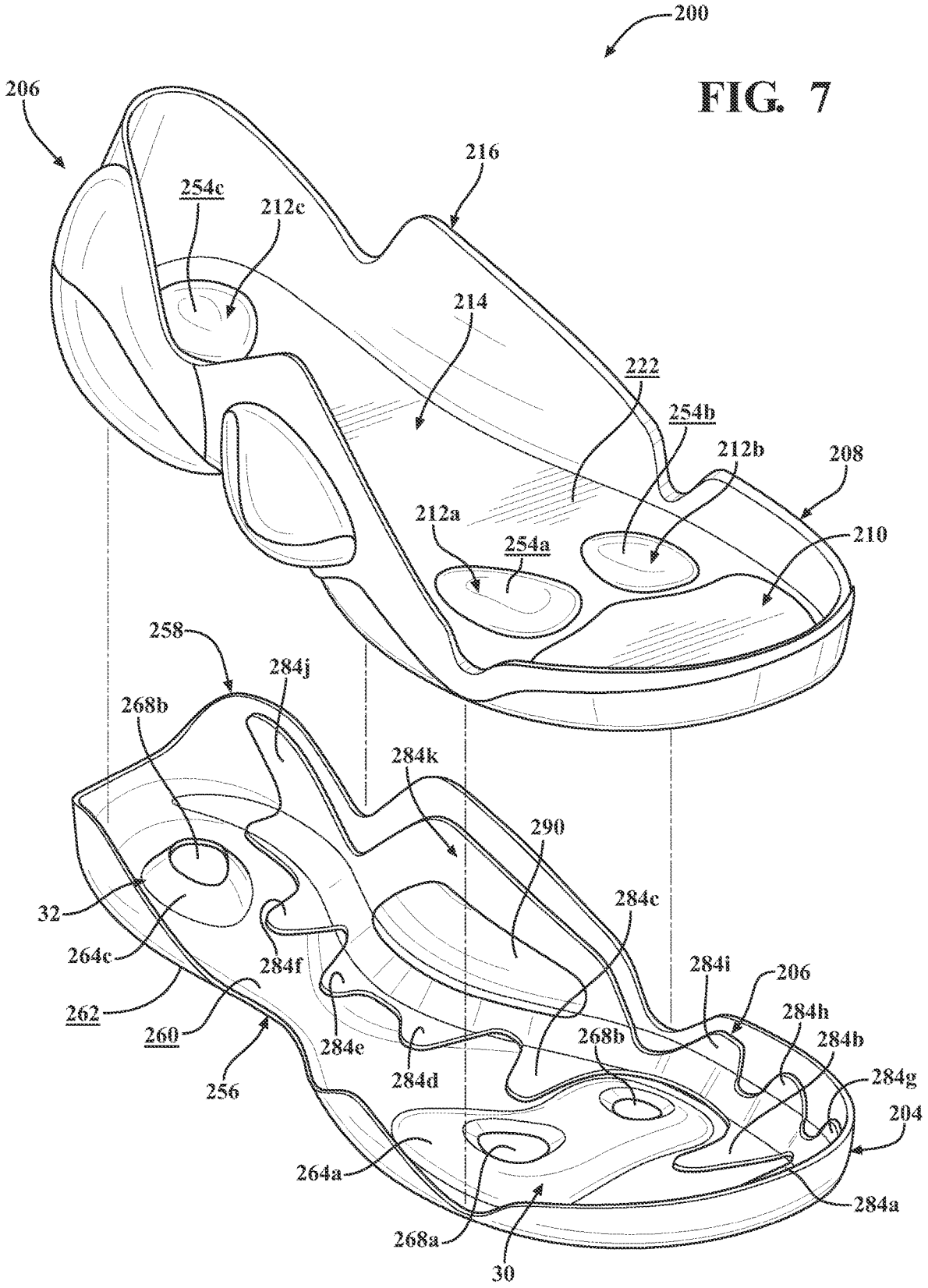
FIG. 7 is an exploded, top-anterior perspective view of the sole structure of FIG. 5, showing the sole structure in a partially assembled state.

Turning now to the exploded views of FIGS. 5-7, the sole structure 200 includes a midsole 202, an outsole 204 attached to the midsole 202, and a spine 206 interposed at least partially between the midsole 202 and the outsole 204. Generally, the midsole 202 is configured to provide characteristics of cushioning and support and the outsole 204 is configured to impart characteristics of traction and abrasion resistance. The spine 206 includes one or more materials that are stiffer than the materials forming the midsole 202 and the outsole 204, and provides increased rigidity and lateral support along targeted regions of the sole structure 200.

In the illustrated example, the midsole 202 is formed as a composite structure and includes a chassis 208, a toe pad 210, and a plurality of haptic elements 212*a*-212*c* corresponding to pressure points of the foot. In the illustrated example, the haptic elements 212*a*-212*c* include a first pair of forefoot haptic elements 212*a*, 212*b* associated with the ball portion $\mathbf{20}_B$ of the foot, and a heel haptic element 212*c* associated with the heel region 24 of the foot.

The chassis 208 may be described as including a footbed 214 and a peripheral wall 216 projecting from the footbed 214. The footbed 214 extends continuously from a first end 218 of the chassis 208 at the anterior end 12 of the footwear 10, to a second end 220 of the chassis 208 at the posterior end 14 of the footwear 10. The footbed 214 and the peripheral wall 216 cooperate to define an interior surface 222 of the chassis 208, and an outer surface 224 of the chassis 208 that is formed on an opposite side from the interior surface 222. Here, a distance from the interior surface 222 to the outer surface 224 defines a thickness of the chassis 208. The portion of the interior surface 222 formed by the footbed 214 is configured to support a plantar surface of the foot, while the portion of the interior surface 222 formed by the peripheral wall 216 provides lateral (i.e., side-to-side, front-to-back) support around the periphery of the foot. As described in greater detail below, the outer surface 224 of the chassis 208 may be configured to provide interfaces with each of the outsole 204 and the spine 206 of the sole structure 200 when the sole structure 200 is assembled.

Figure 9:
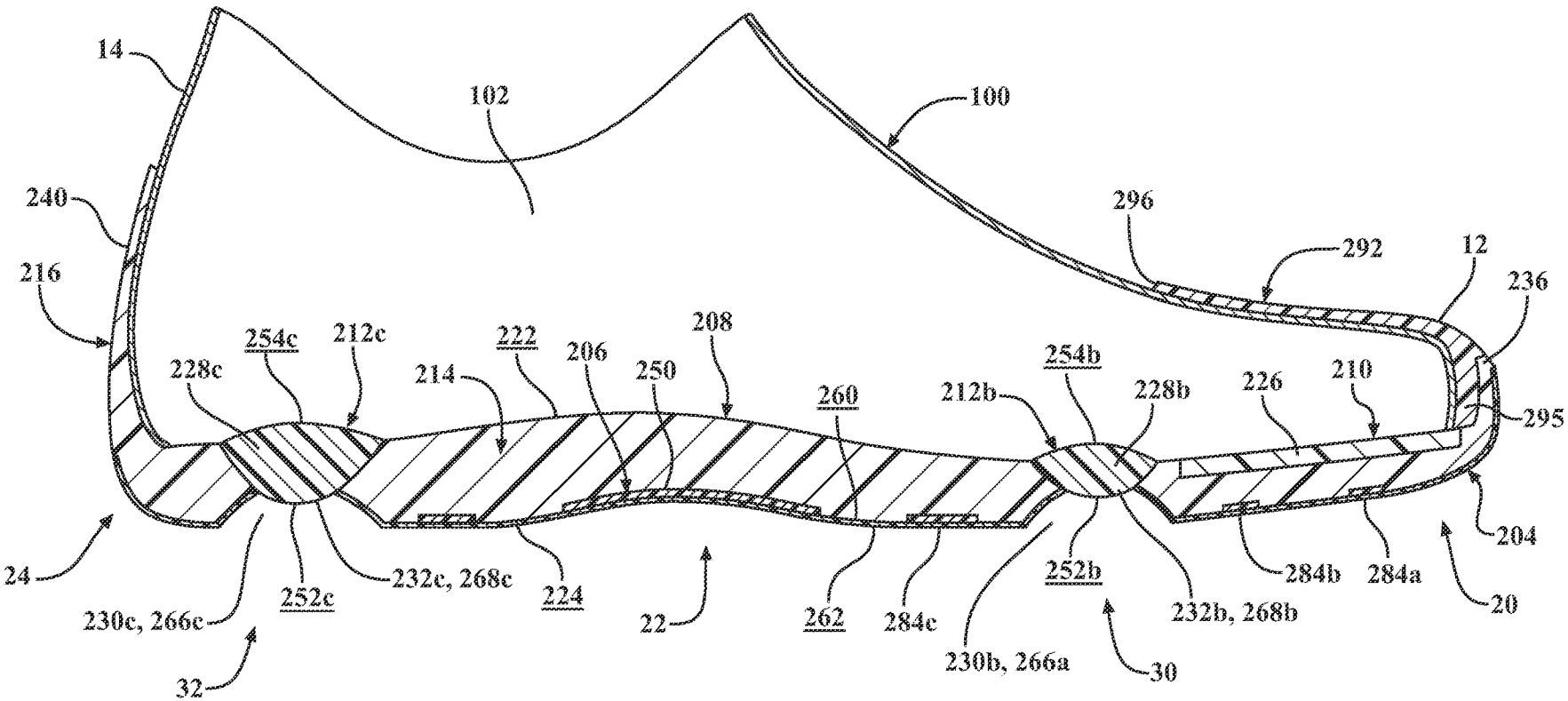
FIG. 9 is a cross-sectional view of an article of footwear according to principles of the present disclosure, taken along Line 9-9 of FIG. 8.

As best shown in FIGS. 5 and 6, the footbed 214 includes a plurality of surface features configured to receive components of the midsole 202 and the sole structure 200. For instance, the footbed 214 includes a toe recess 226 formed in the interior surface 222 adjacent to the first end 218, which is configured to receive the toe pad 210 therein. As shown, the toe recess 226 has a peripheral profile and depth corresponding to a peripheral profile and thickness of the toe pad 210, such that when the toe pad 210 is inserted within the toe recess 226, the toe pad 210 and the footbed 214 cooperate to form a substantially continuous and flush surface in the toe portion $\mathbf{20}_T$ of the midsole 202, as illustrated in FIG. 9.

The footbed 214 further includes a plurality of sockets 228*a*-228*c* formed through the inner surface 222 and extending at least partially though the thickness of the chassis 208. In the illustrated examples, the sockets 228*a*-228*c* include a pair of forefoot sockets 228*a*, 228*b* each configured to receive one of the forefoot haptic elements 212*a*, 212*b*, and a heel socket 228*c* configured to receive the heel haptic element 212*c*. Accordingly, the forefoot sockets 228*a*, 228*b* are aligned with each other along a metatarsophalangeal axis $A_{MTP}$ (FIG. 8), while the heel socket 228*c* is aligned with the calcaneus bone of the foot.

Figure 8:
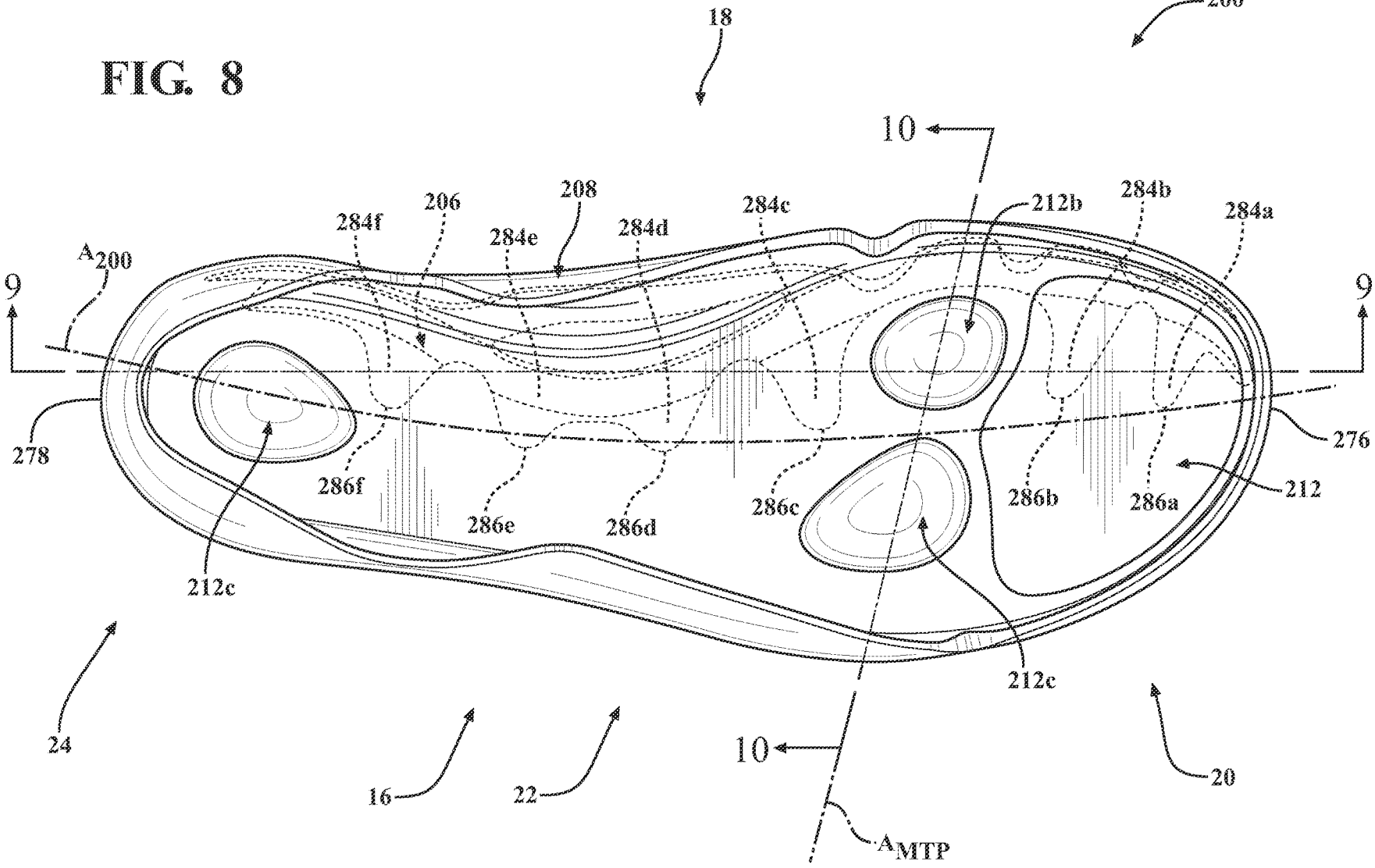
FIG. 8 is a top plan view of the sole structure of FIG. 5.

In the illustrated example, each of the sockets 228*a*-228*c* has a cross-sectional shape corresponding to a cross-sectional shape of a respective one of the haptic elements 212*a*-212*c*. Generally, each of the sockets 228*a*-228*c* may be described as having a polycentric cross-sectional shape, whereby the cross-sectional shape is continuously rounded, but has more than one axis of symmetry. For example, the sockets 228*a*-228*c* may be described as having different D-shaped, oval-shaped, or egg-shaped cross-sections corresponding to the shapes of the haptic elements 212*a*-212*c*, as best shown in FIG. 8.

The footbed 214 may further include one or more reliefs 230*a*, 230*c* extending at least partially through the thickness of the chassis 208 from the outer surface 224, and corresponding to the locations of the sockets 228*a*-228*c*. With reference to FIG. 5, the outer surface 224 includes a forefoot relief 230*a* corresponding to the forefoot sockets 228*a*, 228*b* and a heel relief 230*c* corresponding to the heel socket 228*c*.

As discussed below, the reliefs 230*a*, 230*c* of the footbed 214 are configured to cooperate with corresponding features in the outsole 204 to provide secondary traction regions 30, 32 to the sole structure 200.

As shown, the reliefs 230*a*, 230*c* intersect with each of the sockets 228*a*-228*c* in an intermediate portion (i.e., between the inner and outer surface) of the footbed 214 to form a plurality of openings 232*a*-232*c* through the footbed 214. When the midsole 202 is assembled and each of the haptic elements 212*a*-212*c* is situated within one of the sockets 228*a*-228*c*, each of the haptic elements 212*a*-212*c* is exposed to the ground surface through the openings 232*a*-232*c*. As discussed in greater detail below, in some examples, portions of the haptic elements 212*a*-212*c* may be received through the openings 232*a*-232*c* and partially extend into the respective reliefs 230*a*, 230*c*.

As best shown in FIGS. 5-7, the peripheral wall 216 of the chassis 208 extends transversely from the footbed 214 and completely surrounds the footbed 214 to provide lateral support and cushioning around the outer periphery of the footwear 10. A height $H_{216}$ of the peripheral wall 216—measured from the interior surface 222 of the footbed to a distal end 234 of the peripheral wall 216—is variable along the perimeter of the footbed 214. In the illustrated example, the peripheral wall 216 may be described as including a forefoot portion 236, lateral and medial mid-foot portions 238*a*, 238*b*, and a heel portion 240 each having a different height $H_{216}$.

The peripheral wall 216 may include one or more reliefs or notches 242*a*, 242*b* formed in the peripheral edge between adjacent ones of the peripheral wall portions 236, 238*a*, 238*b*, 240. The notches 242*a*, 242*b* provide flex points in the peripheral wall 216 and allow the chassis 208 to flex or bend longitudinally. In the illustrated example, the peripheral wall 216 includes a lateral notch 242*a* formed between the forefoot portion 236 and the lateral mid-foot portion 238*a*, and a medial notch 242*b* formed between the forefoot portion 236 and the medial mid-foot portion 238*b*.

As shown, the forefoot portion 236 of the peripheral wall 216 extends from a lateral end 244*a* on the lateral side 16 of the footbed 214 in the forefoot region 20, and around the first end 218 of the chassis 208 to a medial end 244*b* on the medial side 18 of the chassis 208 in the forefoot region 20. As shown, the height $H_{216}$ of the peripheral wall 216 is substantially constant along the length of the forefoot portion 236.

On the lateral side, the lateral mid-midfoot portion 238*a* of the peripheral wall 216 extends from an anterior end 244*c* adjacent to and facing the lateral end 244*a* of the forefoot portion 236, to a posterior end 244*d* disposed between the mid-foot region 22 and the heel region 24. Similarly, the medial mid-foot portion 238*b* of the peripheral wall 216 extends from an anterior end 244*e* adjacent to and facing the medial end 244*b* of the forefoot portion 236, to a posterior end 244*f* disposed between the mid-foot region 22 and the heel region 24. On each of the lateral mid-foot portion 238*a* and the medial mid-foot portion 238*b*, the height $H_{216}$ of the peripheral wall 216 increases from the respective anterior end 244*c*, 244*e* and the respective posterior end 244*d*, 244*f* towards an apex 246*a*, 246*b* formed between the anterior end 244*c*, 244*e* and the posterior end 244*d*, 244*f*. Longitudinal positions of the apexes 246*a*, 246*b* correspond with high points of the medial and lateral arches of the foot.

The heel portion 240 of the peripheral wall 216 extends from a lateral end 244*g* adjacent to and facing the posterior end 244*d* of the lateral mid-foot portion 238*a*, and around the second end 220 of the chassis 208 to a medial end 244*h* adjacent to and facing the posterior end 244*f* of the medial mid-foot portion 238*b*. As shown, the ends 244*g*, 244*h* of the heel portion 240 may intersect or connect to the ends 244*d*, 244*f* of the respective mid-foot portions 238*a*, 238*b*. Like the mid-foot portions 238*a*, 238*b*, the heel portion 240 may have a variable height $H_{208}$, where the height $H_{216}$ increases from each end 244*g*, 244*h* to an apex 246*c* at the second end 220 of the chassis 208.

The peripheral wall 216 may include one or more support pods 248*a*, 248*b* formed on the outer surface 224 thereof. In the illustrated example, the peripheral wall 216 includes a mid-foot support pod 248*a* formed on the lateral mid-foot portion 238*a*, and a heel support pod 248*b* formed on the heel portion 240 on the lateral side 16. Each of the support pods 248*a*, 248*b* has a hemispherical shape, and forms a bulge or bulbous region along the outer surface 224 of the peripheral wall 216. The support pods 248*a*, 248*b* cooperate to provide an increased stiffness and additional ground contact surface along the lateral side 16 of the footwear 10. In some instances, at least a lower portion of each support pod 248*a*, 248*b* may be covered with a material having greater traction and abrasion resistance than the remainder of the chassis 208. Alternatively, the pods 248*a*, 248*b* may be accommodated within the outsole 204 when the sole structure 200 is assembled.

Figure 10:
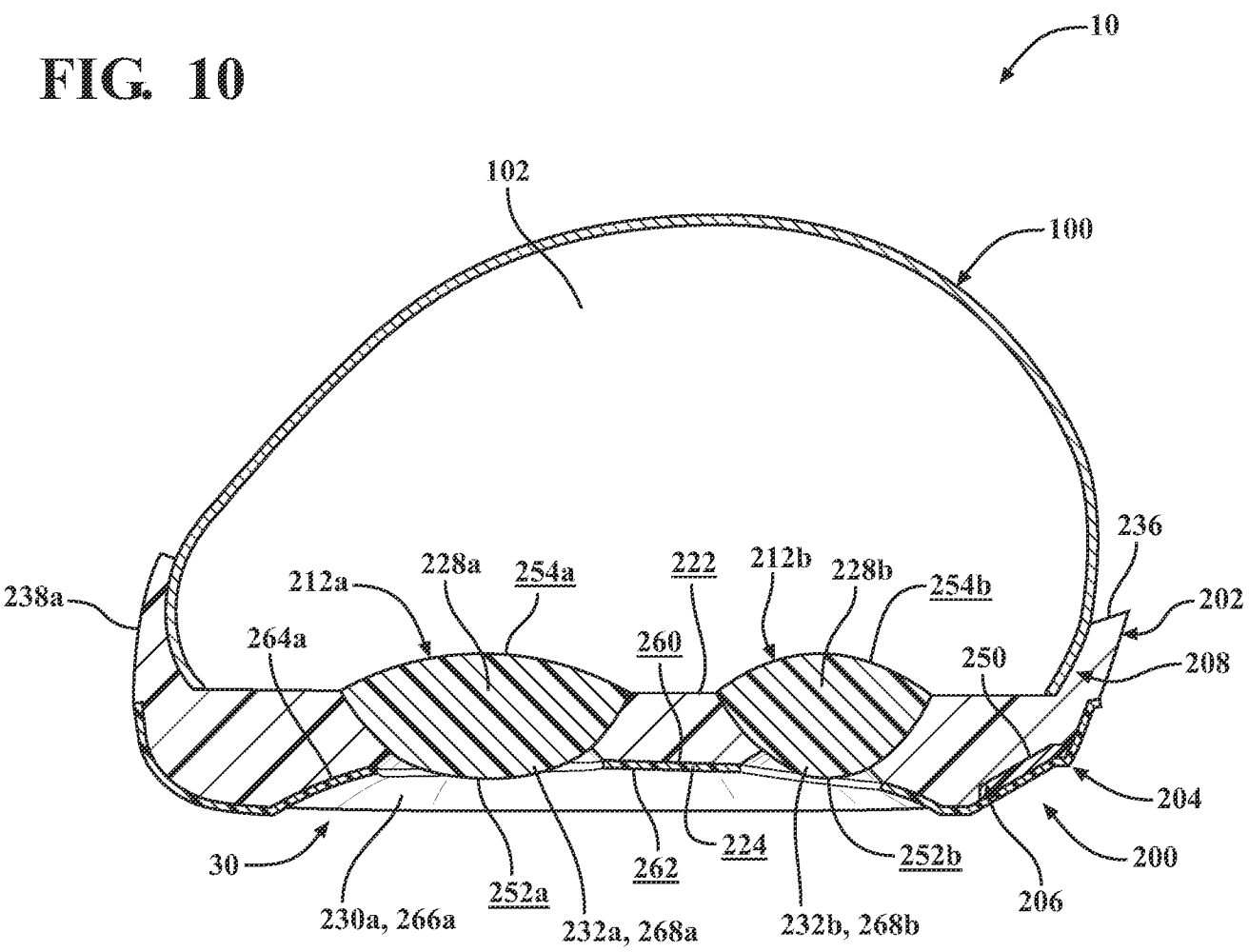
FIG. 10 is a cross-sectional view of an article of footwear according to principles of the present disclosure, taken along Line 10-10 of FIG. 8.

With continued reference to FIG. 5, the chassis 208 includes a spine receptacle 250 formed in the outer surface 224, which is configured to receive the spine 206 of the sole structure 200 when the sole structure 200 is assembled. As shown, a depth and peripheral shape of the spine receptacle 250 correspond to the thickness and peripheral profile of the spine 206, such that the spine 206 and the outer surface 224 of the chassis 208 are substantially continuous and flush when the sole structure 200 is assembled, as shown in FIGS. 9 and 10.

In addition to the chassis 208, the midsole 202 includes the haptic elements 212*a*-212*c* received in respective ones of the sockets 228*a*-228*c*. The haptic elements 212*a*-212*c* each include a bottom surface 252*a*-252*c* that is received within one of the sockets 228*a*-228*c*, and a top surface 254*a*-254*c* formed on an opposite side from the bottom surface 252*a*-252*c*. When the bottom surfaces 252*a*-252*c* of the haptic elements 212*a*-212*c* are inserted into the respective sockets 228*a*-228*c*, the peripheral edges of the top surfaces 254*a*-254*c* of the haptic elements 212*a*-212*c* are aligned (e.g., flush) with the interior surface 222 of the footbed 214 to provide a continuous surface along the footbed 214. However, the top surfaces 254*a*-254*c* of the haptic elements 212*a*-212*c* may be convex or dome-shaped, such that the top surfaces 254*a*-254*c* protrude into the interior void 102 of the upper 100 and provide proprioceptive stimulation to the plantar surface of the foot.

As discussed below, the illustrated haptic elements 212*a*-212*c* may be formed of a resilient polymeric material. However, in other examples, the haptic elements 212*a*-212*c* may include bladders filled with a compressible fluid or media. Optionally, respective ones of the haptic elements 212*a*-212*c* may be formed with different mechanical properties. For instance, the forefoot haptic elements 212*a*, 212*b* may be formed with a greater hardness (e.g., higher durometer or pressure) than heel haptic element 212*c*. As such, the forefoot haptic elements 212*a*, 212*b* are configured to provide a greater degree of responsiveness and proprioceptive feedback, while the heel haptic element 212*c* provides greater dampening of impacts incurred during heel strikes.

Additionally or alternatively, one or more of the haptic elements 212*a*-212*c* may be removably disposed within the sockets 228*a*-228*c*, such that a wearer can selectively replace one or more of the haptic elements 212*a*-212*c* with a corresponding haptic element 212*a*-212*c* having different mechanical properties. For example, a wearer may replace a heel haptic element 212*c* having a first hardness and/or construction (e.g., foam, bladder) with a heel haptic element 212*c* having a different hardness and/or construction. Tuning of the haptic elements 212*a*-212*c* may also be done by the manufacturer based on characteristics (e.g., height, weight) or preferences provided by the wearer.

The toe pad 210 is configured to interface with the toe recess 226 in the toe portion $\mathbf{20}_T$ of the chassis 208. As discussed above, a thickness and outer periphery of the toe pad 210 correspond to the depth and peripheral profile of the toe recess 226 such that the toe pad 210 and the chassis 208 are flush and continuous with each other.

In the illustrated example, each of the chassis 208, the toe pad 210, and the haptic elements 212*a*-212*c* includes one or more resilient polymeric materials. The chassis 208 is formed of one or more materials that provide the chassis 208 a higher durometer than the toe pad 210 and the haptic elements 212*a*-212*c*. Accordingly, the toe pad 210 and/or one or more of the haptic elements 212*a*-212*c* are configured to provide a softer underfoot feel than the footbed 214.

Example resilient polymeric materials for the midsole components 208, 210, 212-212*a* may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

As shown in the figures, the outsole 204 is attached to the outer surface 224 of the chassis 208, such that the spine 206 is interposed between the chassis 208 and the outsole 204. The outsole 204 includes a ground-engaging element 256 and a flange 258 extending transversely from the ground-engaging element 256. The ground-engaging element 256 and the flange 258 of the outsole 204 cooperate to define an inner surface 260 and an exterior surface 262 on an opposite side from the inner surface 260. Here, the inner surface 260 opposes or faces the outer surface 224 of the chassis 208, such that the spine 206 is interposed between the inner surface 260 and the outer surface 224 when the sole structure 200 is assembled.

The ground-engaging element 256 of the outsole 204 may include one or more protuberances 264*a*, 264*c* configured to interface with the reliefs 230*a*, 230*c* formed in the outer surface 224 of the chassis 208. Particularly, the protuberances 264*a*, 264*c* are formed by portions of the ground-engaging element 256 that protrude into and are received by the reliefs 230*a*, 230*c*. Here, the protuberances have a substantially similar thickness to the surrounding portions of the ground-engaging element 256, such that the protuberances 264*a*, 264*c* define depressions 266*a*, 266*c* on the exterior surface 262 of the ground-engaging element 256.

Optionally, ground-engaging element 256 may include apertures 268*a*-268*c* extending through a thickness of the outsole 204 at the protuberances 264*a*, 264*c*. The shape and position of the apertures 268*a*-268*c* corresponds with the shape and position of the openings 232*a*-232*c*, such that when the sole structure 200 is assembled, the respective haptic elements 212*a*-212*c* will be exposed to the ground surface through each of the openings 232*a*-232*c* of the chassis 208 and the apertures 268*a*-268*c* of the outsole 204.

As shown in FIGS. 9 and 10, the bottom surfaces 252*a*-252*c* of the haptic elements 212*a*-212*c* may be spaced apart from a ground plane when the sole structure 200 is in an uncompressed state. In other words, the bottom surfaces 252*a*-252*c* are inwardly offset from the exterior surface 262 of the ground-engaging element 256. Here, spaces formed within the depressions 266*a*, 266*c* and around the bottom surfaces 252*a*-252*c* of the haptic elements 212*a*-212*c* allow the sole structure 200 to provide progressive ground engagement as the sole structure 200 is compressed under the foot. For example, as a vertical compression force is applied over the ball portion $\mathbf{20}_B$ or the heel region 24, the protuberances 264*a*, 264*c* and the haptic elements 212*a*-212*c* will be biased towards the ground plane. When a threshold compression force is applied, the haptic elements 212*a*-212*c* will contact and compress against the ground surface to provide secondary traction. Simultaneously, proprioceptive feedback may be provided to the plantar surface of the foot through each of the haptic elements 212*a*-212*c* to provide the wearer with an increased sense of the engagement with the ground surface. Accordingly, the regions of the sole structure 200 associated with the haptic elements 212*a*-212*c* may be described as secondary traction regions 30, 32. Here, the sole structure 200 includes a forefoot secondary traction region 30 and a heel secondary traction region 32.

The flange 258 of the outsole 204 is configured to extend at least partially over the peripheral wall 216 of the chassis 208. Accordingly, the height $H_{258}$ of the flange 258 is variable and may correspond to heights $H_{216}$ of one or more of the portions 236, 238*b*, 240 of the chassis 208. For instance, in the illustrated example, the flange 258 includes a forefoot portion 270 extending along the forefoot portion 236 of the chassis 208, a medial mid-foot portion 272 extending along the medial mid-foot portion 238*b*, and a heel portion 273 extending at least partially along the heel portion 240 of the chassis 208. The flange 258 may also include one or more notches 274*a*, 274*b* aligned with the locations of the notches 242*a*, 242*b* of the chassis 208.

With renewed reference to FIGS. 5 and 6, the spine 206 is situated between the midsole 202 and the outsole 204, and is configured to provide targeted structural support along the medial side 18 of the footbed 214 and peripheral wall 216. Accordingly, the spine 206 includes one or more materials having a greater stiffness or hardness than the materials forming the chassis 208 and the outsole 204. In some examples, the spine 206 may include a rigid polymeric material, such as a thermoplastic polyurethane (TPU). However, the spine 206 may be formed of or include other rigid or semi-rigid materials, such as polymers, composites, or metals.

The spine 206 extends along the medial side 18 of the sole structure 200 from a first end 276 at the anterior end 12 to a second end 278 in the heel region 24. The spine 206 includes a base 280 configured to extend along the plantar surface of the foot between the footbed 214 and the outsole 204, and a sidewall 282 extending transversely from the base 280 and along the peripheral wall 216 on the medial side 18 of the sole structure 200. Generally, the spine 206 is configured to provide a combination of lateral stiffness and longitudinal flexibility along the medial side 18 of the sole structure 200 to aid in supporting the foot during movements (e.g., twists, cuts) towards the medial side 18.

Each of the base 280 and the sidewall 282 may include a series of undulations forming a plurality of supports 284*a*-284*k* and flexures 286*a*-286*i* along the length of the spine 206. Generally, the supports 284*a*-284*k* cooperate to provide reinforcement in the lateral direction, while the flexures 286*a*-286*i* facilitate longitudinal flexibility along the sole structure 200. Particularly, the flexures 286*a*-286*i* are formed as reliefs between adjacent ones of the supports 284*a*-284*k*, which allow the spine 206 to flex.

Along the base 280, the undulations form laterally-extending base supports 284*a*-284*f* that extend between the footbed 214 of the midsole 202 and the ground-engaging element 256 of the outsole 204. The base supports 284*a*-284*f* include a first pair of supports 284*a*, 284*b* disposed in the toe portion $\mathbf{20}_T$ between the anterior end 12 and the forefoot secondary traction region 30. The base supports 284*a*-284*f* further include a series of posterior base supports 284*c*-284*f* spaced along the mid-foot region 22 and the heel region 24. As shown, the base supports 284*a*-284*f* each extend only partially across a width of the sole structure 200. Particularly, each of the base supports 284*a*-284*f* extends laterally (e.g., across the width of the sole structure) from the sidewall 282 on the medial side 18 and terminates at a distal end 285*a*-285*f* on a medial side of a central axis $A_{200}$ of the sole structure 200. Accordingly, the spine 206 is isolated to the medial side 18 of the sole structure, such that the base supports 284*a*-284*f* are configured to provide lateral reinforcement for the sidewall 282, while still allowing lateral flexibility across the width of the sole structure.

Along the sidewall 282, the undulations form a plurality of sidewall supports 284*g*-284*k* extending between the peripheral wall 216 and the flange 258. The sidewall 282 includes a first series of sidewall supports 284*g*-284*i* extending along the medial side 18 in the forefoot region 20 and a fourth sidewall support 284*j* in the heel region 24. Additionally, the spine 206 may include a mid-foot sidewall support 284*k* disposed in the mid-foot region 22, which extends from a first end 288*a* adjacent to the forefoot region 20, to a second end 288*b* adjacent to the heel region 24. In some examples, the mid-foot sidewall support 284*k* may include an opening 290 formed therethrough, such that the mid-foot sidewall support 284*k* is formed as a rib extending along the medial side 18 from the first end 288*a* to the second end 288*b*.

Optionally, the sole structure 200 may also include a toe cap 292 disposed in the forefoot region 20. The toe cap 292 is configured to cooperate with the chassis 208 to enclose and protect the upper 100 in the forefoot region 20. The toe cap 292 includes a resilient polymeric material, as discussed above with respect to the components 208, 210, 212*a*-212*c* of the midsole 202. Here, the resilient polymeric material of the toe cap 292 is softer than the material of at least the chassis 208, such that the toe cap 292 provides a protective layer over the forefoot region 20.

As shown, the toe cap 292 includes a peripheral edge 294 that interfaces with the peripheral wall 216 of the chassis 208. In some examples, the toe cap 292 may include a peripheral lip 295 that extends from the peripheral edge 294 and is received within the chassis 208. Here, the peripheral lip 295 is configured to extend along the interior surface 222 of the forefoot portion 236 of the peripheral wall 216. The toe cap 292 extends continuously from the anterior end 12 to a terminal edge 296 that extends from the lateral side 16 to the medial side 18 in the ball portion $\mathbf{20}_B$. As shown in FIGS. 4A and 4B, the terminal edge 296 may be contoured from the lateral side 16 to the medial side 18, such that the terminal edge 296 is concave and curves towards the posterior end 14 along a direction from the lateral side 16 to the medial side 18.

Optionally, the peripheral edge 294 of the toe cap 292 may include one or more notches 298*a*, 298*b* corresponding to the notches 242*a*, 242*b* of the chassis 208. In other words, the notches 298*a*, 298*b* of the toe cap 292 are aligned with and oppose (i.e. face) the notches 242*a*, 242*b* of the chassis 208, such that the notches 298*a*, 298*b* of the toe cap 292 and the notches 242*a*, 242*b* of the chassis 208 cooperate to define openings through the sole structure 200. In the illustrated example, the toe cap 292 includes a first notch 298*a* formed on the lateral side 16, opposite the first notch 242*a* of the chassis 208, and a second notch 298*b* formed on the medial side 18, opposite the second notch 242*b* of the chassis 208. Thus, the notches 242*a*, 242*b*, 298*a*, 298*b* cooperate to form openings on each of the lateral side 16 and the medial side 18 in the forefoot region 20.

The following Clauses provide an exemplary configuration for an article of footwear described above.

Clause 1: A sole structure for an article of footwear, the sole structure comprising a chassis including a footbed having an interior surface and an outer surface formed on an opposite side from the interior surface, the interior surface defining one or more sockets and one or more haptic elements each having a bottom surface received within a respective one of the one or more sockets and a top surface protruding from the interior surface of the chassis, each of the one or more haptic elements having a different hardness than the footbed.

Clause 2: The sole structure of Clause 1, wherein at least one of the one or more haptic elements is disposed in a forefoot region of the chassis.

Clause 3: The sole structure of Clause 1 or 2, wherein at least one of the one or more haptic elements is disposed in a heel region of the chassis.

Clause 4: The sole structure of any one of Clauses 1-3, wherein each of the one or more haptic elements has a lower hardness than the footbed.

Clause 5: The sole structure of any one of Clauses 1-4, wherein the one or more haptic elements includes a first haptic element having a first hardness and a second haptic element having a second hardness.

Clause 6: The sole structure of Clause 5, wherein the first haptic element is disposed in a forefoot region of the chassis and the second haptic element is disposed in a heel region of the chassis.

Clause 7: The sole structure of any one of Clauses 1-6, wherein each of the one or more sockets forms an opening in the chassis, the bottom surface of each of the one or more haptic elements being exposed through the opening.

Clause 8: The sole structure of Clause 7, wherein the bottom surface of each of the one or more haptic elements protrudes through the opening.

Clause 9: The sole structure of any one of Clauses 1-8, further comprising an outsole having an inner surface facing the outer surface of the chassis and an exterior surface formed on an opposite side of the outsole than the inner surface, the bottom surface of each of the one or more haptic elements extending at least partially through the outsole.

Clause 10: The sole structure of Clause 9, wherein the outer surface of the outsole includes one or more depressions each surrounding at least one of the one or more haptic elements.

Clause 11: A sole structure for an article of footwear, the sole structure comprising a chassis including a footbed having a first hardness and a plurality of sockets formed at least partially through the footbed and one or more haptic elements each received within a respective one of the sockets and having a top surface protruding from the footbed of the chassis, each of the one or more haptic elements having a different hardness than the first hardness.

Clause 12: The sole structure of Clause 11, wherein at least one of the one or more haptic elements is disposed in a forefoot region of the chassis.

Clause 13: The sole structure of Clause 11 or 12, wherein at least one of the one or more haptic elements is disposed in a heel region of the chassis.

Clause 14: The sole structure of any one of Clauses 11-13, wherein each of the one or more haptic elements has a lower hardness than the footbed.

Clause 15: The sole structure of any one of Clauses 11-14, wherein the one or more haptic elements includes a first haptic element having a second hardness and a second haptic element having a third hardness different than the second hardness.

Clause 16: The sole structure of Clause 15, wherein the first haptic element is disposed in a forefoot region of the chassis and the second haptic element is disposed in a heel region of the chassis.

Clause 17: The sole structure of any one of Clauses 11-16, wherein each of the one or more sockets forms a respective opening in the chassis, each of the one or more haptic elements exposed through one of the openings.

Clause 18: The sole structure of Clause 17, wherein each of the one or more haptic elements protrudes through one of the openings.

Clause 19: The sole structure of Clause 17 or 18, further comprising an outsole attached to the footbed and including one or more apertures aligned with each of the openings.

Clause 20: The sole structure of Clause 19, wherein each of the one or more haptic elements is exposed to and spaced apart from a ground surface through a respective one of the one or more apertures.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A sole structure for an article of footwear, the sole structure comprising:

a chassis including a footbed, the chassis having an interior surface and an outer surface formed on an opposite side from the interior surface, the interior surface defining one or more sockets, the footbed including a recess and one or more reliefs extending into the outer surface of the chassis and partially through the chassis;

one or more asymmetrical haptic elements each having a bottom surface received within a respective one of the one or more sockets and a top surface protruding from the interior surface of the chassis, each of the one or more haptic elements having a different hardness than the footbed;

a pad disposed within the recess of the footbed, the pad having a different hardness than the footbed; and an outsole attached to the footbed including one or more protuberances received by the one or more reliefs, wherein the outsole includes one or more depressions on an exterior surface of a ground-engaging element defined by the outsole, the one or more depressions being defined by the one or more protuberances to surround the one or more haptic elements.

2. The sole structure of claim 1, wherein at least one of the one or more haptic elements is disposed in a forefoot region of the chassis, and wherein at least one of the one or more haptic elements is disposed in a heel region of the chassis, each of the one or more haptic elements having a lower hardness than the footbed.

3. The sole structure of claim 1, wherein the one or more haptic elements includes a first haptic element having a first hardness and a second haptic element having a second hardness, and wherein the first haptic element is disposed in a forefoot region of the chassis and the second haptic element is disposed in a heel region of the chassis.

4. The sole structure of claim 1, wherein each of the one or more sockets forms an opening in the chassis, the bottom surface of each of the one or more haptic elements being exposed through the opening, and wherein the bottom surface of each of the one or more haptic elements protrudes through the opening.

5. The sole structure of claim 1, wherein the outsole includes an inner surface facing the outer surface of the chassis and the exterior surface formed on an opposite side of the outsole than the inner surface, the bottom surface of each of the one or more haptic elements extending at least partially through the outsole, wherein each of the one or more depressions surrounds at least one of the one or more haptic elements.

6. The sole structure of claim 1, wherein the one or more sockets includes a rounded polycentric cross-sectional shape having more than one axis of symmetry, and wherein the one or more sockets include a first socket disposed within a ball region of the article of footwear and a second socket disposed within a heel region of the article of footwear.

7. The sole structure of claim 1, wherein the bottom surface extends through a respective one or more sockets and extends into a portion of the one or more reliefs.

8. The sole structure of claim 1, wherein the one or more asymmetrical haptic elements are exposed to a ground surface through a respective socket, and wherein the one or more asymmetrical haptic elements and the one or more protuberances received by the one or more reliefs form a secondary traction region, the secondary traction region forming a portion of the ground-engaging surface when a vertical compression force is applied to the article of footwear.

9. The sole structure of claim 1, wherein the one or more reliefs includes a forefoot relief and a heel relief, the one or more sockets includes a pair of forefoot sockets, and a heel socket, and wherein the forefoot relief is configured to house the pair of forefoot sockets and the heel relief is configured to house the heel socket.

10. The sole structure of claim 1, wherein the top surface of the one or more asymmetrical haptic elements includes a dome shape, the one or more asymmetrical haptic elements comprising a bladder filled with a compressible fluid or media, and wherein the pad disposed within the recess forms a substantially flush top surface of the footbed.

11. The sole structure of claim 1, wherein one of the one or more asymmetrical haptic elements comprises a shape that is different than another of the one or more asymmetrical haptic elements, and wherein one of the one or more sockets comprises a shape that is different than another of the one or more sockets.

12. The sole structure of claim 1, wherein the top surface of the one or more asymmetrical elements is wider than the bottom surface of the one or more asymmetrical haptic elements, the top surface tapering downward toward the bottom surface, and wherein the one or more sockets tapers downward from the footbed toward a ground surface.

13. The sole structure of claim 1, wherein the one or more asymmetrical haptic elements includes at least one forefoot haptic element and at least one heel haptic element, and wherein the at least one forefoot haptic element has a hardness greater than that of the at least one heel haptic element.

14. A sole structure for an article of footwear, the sole structure comprising:

a central axis extending from an anterior end of the article of footwear to a posterior end of the article of footwear;

a chassis including a footbed having a first hardness and a plurality of sockets formed at least partially through the footbed, the footbed including one or more reliefs extending into an outer surface of the chassis and partially through the chassis, wherein the plurality of sockets are aligned along a metatarsophalangeal axis, the metatarsophalangeal axis extending from a medial side of the article of footwear to a lateral side of the article of footwear and intersecting the central axis in a forefoot region of the article of footwear;

a first asymmetrical haptic element received within a first socket of the plurality of sockets and having a top surface protruding from the footbed of the chassis and a bottom surface opposite the top surface, the first asymmetrical haptic element having an anterior edge and a posterior edge, the bottom surface extending through a corresponding asymmetrical opening disposed in the first socket and partially extending into a portion of the one or more reliefs;

a second asymmetrical haptic element received within a second socket of the plurality of sockets and having a top surface protruding from the footbed of the chassis and a bottom surface opposite the top surface, the second asymmetrical haptic element having an anterior edge and a posterior edge, the bottom surface extending through a corresponding asymmetrical opening disposed in the second socket and partially extending into a portion of the one or more reliefs, wherein the anterior edge of the first asymmetrical is disposed nearer the anterior end of the article of footwear than the anterior edge of the second asymmetrical haptic element, and wherein the posterior edge of the first asymmetrical is disposed nearer the posterior end of the article of footwear than the posterior edge of the second asymmetrical haptic element; and an outsole attached to the footbed, the outsole including one or more apertures, wherein the one more apertures are aligned with each of the corresponding asymmetrical openings, wherein the first haptic element and the second haptic element are exposed and protrude through the corresponding asymmetrical openings, and wherein each of the first haptic element and the second haptic element are exposed to and spaced apart from a ground surface through a respective one of the one or more apertures.

15. The sole structure of claim 14, wherein the first haptic element and the second haptic element are disposed in a forefoot region of the chassis, and wherein a third haptic element is disposed in a heel region of the chassis, each of the first haptic element, the second haptic element, and the third haptic element having a lower hardness than the footbed.

16. The sole structure of claim 14, wherein the first haptic element has a second hardness and the second haptic element has a third hardness different than the second hardness.

17. The sole structure of claim 14, wherein the first haptic element is disposed closer to a medial edge of the article of footwear than the second haptic element, and the second haptic element is disposed closer to a lateral edge of the article of footwear than the first haptic element, and wherein a greatest anterior-posterior dimension of the first haptic element is less than a greatest anterior-posterior dimension of the second haptic element.

18. The sole structure of claim 14, wherein a greatest dimension of the first haptic element along the metatarsophalangeal axis is less than a greatest dimension of the second haptic element along the metatarsophalangeal axis.

19. A sole structure for an article of footwear, the sole structure comprising:

a chassis including:

a footbed that defines an outer surface of the chassis, the outer surface configured to face a ground surface;

one or more reliefs partially extending through a thickness of the chassis from the outer surface;

a peripheral wall that cooperates with the footbed to define an interior surface of the chassis, the interior surface formed on an opposite side from the outer surface;

one or more sockets partially extending through the thickness of the chassis from the interior surface and respectively intersecting with the one or more reliefs, the one or more sockets disposed within a ball region of the article of footwear and a heel region of the article of footwear;

one or more asymmetrical haptic elements each received within a respective one of the sockets and having a first surface protruding from the footbed of the chassis into an interior void of the article of footwear, the one or more sockets having a rounded polycentric cross-sectional shape having more than one axis of symmetry, wherein a peripheral edge of the first surface rests flush with the footbed to form a continuous surface along the footbed; and an outsole attached to the footbed including one or more protuberances received by the one or more reliefs of the chassis.

* * * * *